US006385548B2

(12) United States Patent
Ananthaiyer et al.

(10) Patent No.: US 6,385,548 B2
(45) **Date of Patent: *May 7, 2002**

(54) APPARATUS AND METHOD FOR DETECTING AND CHARACTERIZING SIGNALS IN A COMMUNICATION SYSTEM

(75) Inventors: Satish Ananthaiyer, Mansfield; Eric David Elias, Plainville, both of MA (US)

(73) Assignee: Motorola, Inc., Schaumburg, IL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/990,130

(22) Filed: Dec. 12, 1997

(51) Int. Cl.[7] ..... G10L 9/00

(52) U.S. Cl. ..... 702/73; 702/75; 702/76; 702/79; 704/214; 704/216

(58) Field of Search ..... 702/73, 69, 75–79, 702/124–126, 179, 189, 191, 194, 195, 199, FOR 166, FOR 157, FOR 160; 364/710.12, 724.06, 724.08, 724.09, 821; 704/214, 233, 207, 216; 324/76.57; 708/801, 802, 804, 815, 822

(56) References Cited

U.S. PATENT DOCUMENTS 4,004,096 A * 1/1977 Bauer et al. ..... 704/216
5,353,372 A * 10/1994 Cook et al. ..... 704/216
5,864,792 A * 1/1999 Kim ..... 704/214

OTHER PUBLICATIONS

Ross, M.J.; Shaffer, H.L.; Cohen, A.; Freudberg, R.; Manley, H.J. "Average Magnitude Difference Function Pitch Extractor", IEEE Trans. Acoust., Speech and Signal Proc., vol. ASSP–22, pp. 353–362, Oct. 1974.

* cited by examiner

*Primary Examiner*—Hal Wachsman

(57) ABSTRACT

An apparatus and method to characterize an input communication signal as being a voice, tone or noise signal is provided. The apparatus and method involve measuring variations of pitch over time from a sampled input signal. A minimum value of Average Magnitude Difference Function (AMDF) over a pitch range and an average variation value of the AMDF over sampled intervals are used to determine whether the signal is a voice signal, a tone or noise. Historical data of these values is maintained in a dual buffer arrangement and is used in the determination of signal type by detecting transitions.

16 Claims, 7 Drawing Sheets

APPARATUS AND METHOD FOR DETECTING AND CHARACTERIZING SIGNALS IN A COMMUNICATION SYSTEM

BACKGROUND

1. Field of the Invention

The invention relates generally to communication systems, and more particularly to detecting and characterizing signals in a communication system.

2. Discussion of Related Art

In today's information age, the number of personal computers used a in homes, schools, and businesses continues to proliferate with apparently no end in sight. This increasing use of personal computers has prompted the migration of many applications onto the personal computer. For example, in addition to providing standard computational and networking functionality, the personal computers of today often include such functionality as a modem for exchanging data with other computers, a telephone (including speakerphone), a telephone answering system, a facsimile system, and teleconferencing/videoconferencing system. Thus, the personal computer can take the place of a multitude of otherwise separate devices, often saving cost, simplifying use, and providing additional features as compared to the separate devices.

Whether used as separate devices or together in the personal computer, these communications applications typically have a number of common elements. Specifically, a processor is used for controlling the device, memory is used for storing information, a signal processor is used for generating and processing the electrical signals needed for communication, and interface components are used for interfacing with the communication system and for providing additional signal processing capabilities. When these communication applications are included in the personal computer, it is often convenient to integrate two or more of the applications together so that the common elements do not have to be duplicated. This integration of applications further reduces the cost of providing such communication applications.

With the cost of personal computers falling and the competition among vendors growing, computer manufacturers and third-party vendors are looking for a cost-effective way of providing the many communication applications. One solution is to implement predominantly all of the application functions in software (with the remaining functions implemented in specialized hardware) and to run the software as a software application on the microprocessor in the personal computer. Implementing the often complex signal processing functions in software is feasible today due to the amount of processing resources provided by modern microprocessors. By eliminating most of the dedicated hardware components and utilizing the processing and memory resources of the personal computer, the communication applications can be provided relatively inexpensively.

One issue with such an integrated software implementation is that the communication application software must share the processing resources of the personal computer with other application software such as a word processor, spreadsheet program, or Internet browser. Thus, the software implementation consumes processing resources that otherwise would be available to the other application software. As a result, the performance of the other application software may be adversely affected when the communication applications are running. Thus, it is important to implement the communication applications such that they use as little processing resources as possible, and also to distribute the processing demand so that the communication application software does not control the processing resources for an excessive amount of time.

One type of signal processing function that is utilized in many of the communication applications is the detection of, and distinction between, voice, tone, and noise signals. Uses include voice-activated automatic gain control (AGC) for teleconferencing and videoconferencing; voice detection for the telephone answering system; double-talk detection in the speakerphone application; DTMF tone detection for accessing special services such as retrieving messages from the telephone answering system, accessing voice mailboxes, and for other keypad-controlled services; and detection of special modem and facsimile tones such as dial tone, answer-back tone, call progress tones, and busy tone. These signal processing functions have typically been implemented separately. When running concurrently, these signal processing functions consume a significant amount of processing resources. Therefore, a need remains for an apparatus and method for providing efficient voice, tone, and noise detection which reduces the amount of processing resources required and also distributes the processing demand.

DETAILED DESCRIPTION

Figure 1:
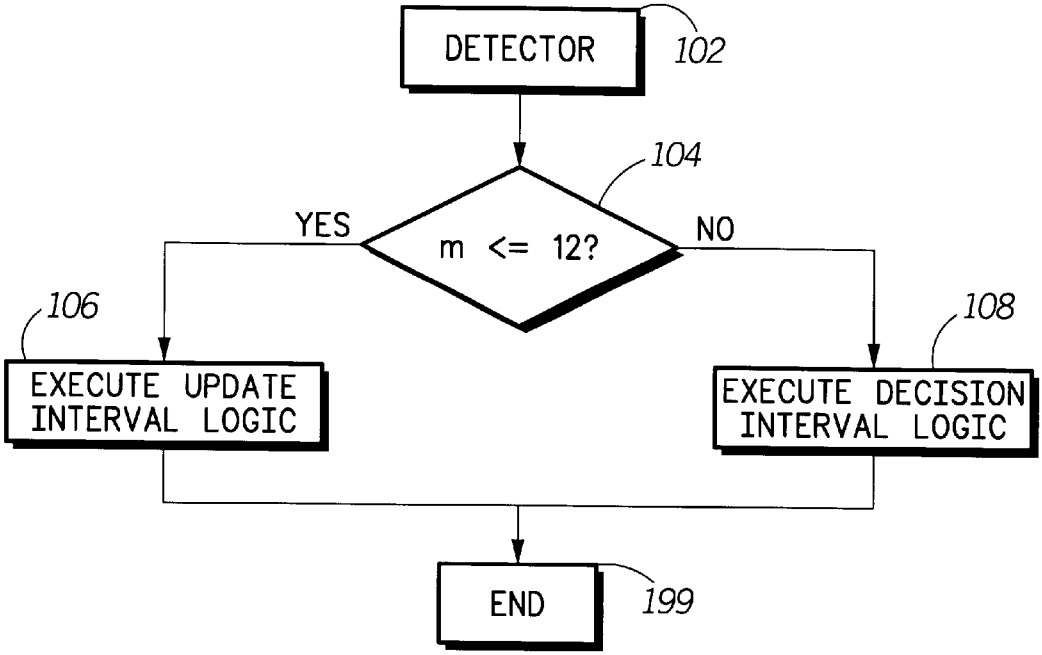
FIG. 1 is a high-level logic flow diagram of a detector.

As discussed above, the need remains for an apparatus and method for providing efficient voice, tone, and noise detection which reduces the amount of processing resources consumed and also distributes the processing demand over time. The present invention provides for such efficient voice, tone, and noise detection by applying the Average Magnitude Difference Function (AMDF) over discrete time intervals to evaluate variations in pitch over time, allowing a hypothesis to be made as to whether a signal is a voice, tone, or noise signal.

AMDF is a well-known technique for pitch estimation which is described in M. J. Ross, H. L. Shaffer, A. Cohen, R. Freudberg, and H. J. Manley, "Average Magnitude Difference Function Pitch Extractor," IEEE Trans. Acoust., Speech and Signal Proc., Vol. ASSP-22, pp. 353–362, October 1974, incorporated herein by reference in its entirety. Briefly, the fundamental concept of the AMDF technique is that, for a truly periodic signal, the difference between two signal samples x(n) and x(n−K) will be zero if K is equal to the pitch period. Because periodic signals may vary slightly due to noise, the difference between two signal samples x(n) and x(n−K) may not be zero but will likely be close to zero at the pitch period K. Thus, the pitch of a signal can be estimated by finding the value K where the difference between the two signal samples x(n) and x(n−K) approaches zero.

The present invention applies the AMDF technique, not for estimating a pitch period K, but rather for evaluating variations in pitch over discrete sample periods to determine whether a signal is a voice signal, a tone signal, or a noise signal. The techniques of the present invention are based on the premise that a tone signal will maintain a relatively constant energy level at its fundamental pitch, a voice signal will have a varying energy level at its fundamental pitch, and a noise signal will have no distinguishable fundamental pitch. Thus, the received signal is analyzed over a predetermined range of pitch periods K, and a set of metrics are computed which characterize the signal as to pitch and variation in pitch. In the preferred embodiment, K is in the range 50 to 140, inclusive, which corresponds roughly to the range of human speech. The novel metrics allow a hypothesis to be made as to whether the signal consists of voice, tone, or noise.

One particular advantage of the preferred embodiments is that the signal analysis is done in the time domain rather than in the frequency domain. The frequency domain approach typically utilizes the Fast Fourier Transform (FFT), which is computationally intensive due to the number of multiplication operations required. The time domain approach of the present invention, on the other hand, utilizes predominantly addition and subtraction operations, and therefore the computational complexity is substantially reduced.

In a preferred embodiment, a detector implemented in software is used to evaluate the signal and to decide whether the signal consists of voice, tone, or noise. In a preferred embodiment, the detector is invoked at 2 millisecond intervals and produces a decision every thirteenth interval based on calculations made during the previous 12 intervals as to whether a voice, tone, or noise signal was present. For convenience, the 13 intervals over which the decision is made is referred to as a "detection cycle," the first 12 intervals of the detection cycle are referred to as "update intervals," and the thirteenth interval of the detection cycle is referred to as the "decision interval." The interval duration as well as the number of intervals per detection cycle are preferred values that have been shown to work well during testing.

A high-level logic flow diagram of the detector is shown in FIG. 1. When the detector logic is invoked for an interval "m" during a detection cycle "i" in step 102, a determination is made in step 104 whether the detector is within the first 12 update intervals of the detection cycle (m less than or equal to 12) or is in the decision interval of the detection cycle (m equal to 13). If the detector is within the first 12 update intervals of the detection cycle, then the logic proceeds to execute the update interval logic in step 106, and then terminates processing for the interval in step 199. If the detector is in the decision interval of the detection cycle, then the logic proceeds to execute the decision interval logic in step 108, and then terminates processing for the interval in step 199.

Figure 5:
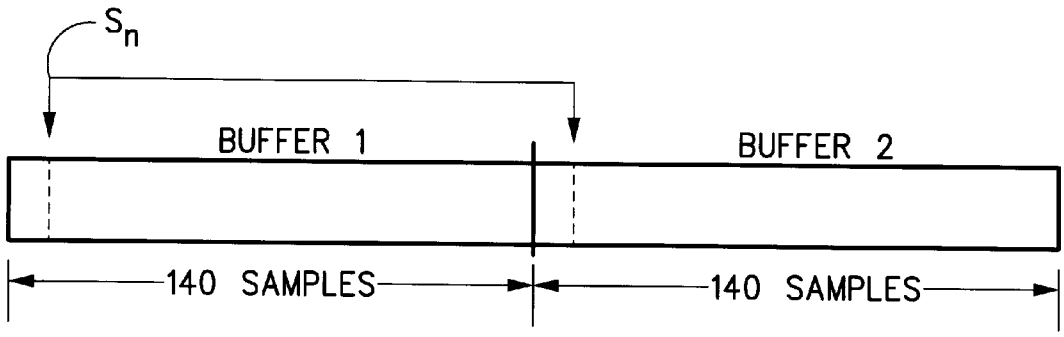
FIG. 5 shows a double buffer system used in an embodiment of the present invention.

When the detector is running, signal processing hardware continually samples and buffers the received signal. The input samples are sampled directly from the line (i.e., not AGC adjusted) and are signed 16-bit integers in the range +/−32,767. In the preferred embodiment, a double buffer system as shown in FIG. 5 is employed for storing the input samples. The two buffers are contiguous, and each stores X input samples (X>140). The two buffers are initially filled with zeros. Each input sample $S_n$ is stored at an equivalent slot in each buffer, so that the stored samples are X slots apart. Each buffer is treated as a circular buffer in that each slot is overwritten with a new sample every X samples.

Figure 6:
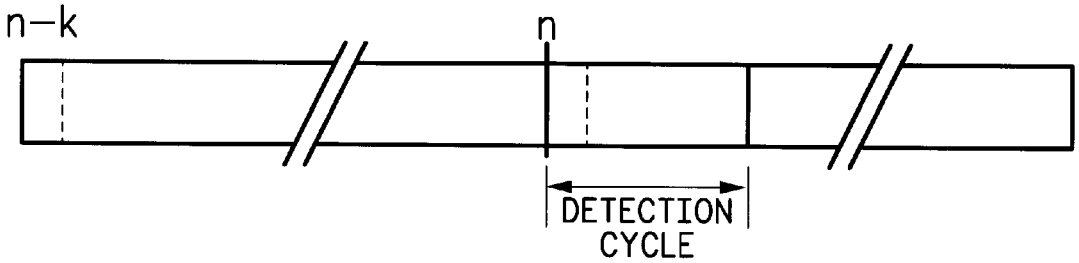
FIG. 6 shows two samples n and n−K stored in the double buffer system.

During each update interval m, the update interval logic operates on the buffer of input samples. In the preferred embodiment, the interval m is 2 milliseconds and the sampling rate is 8 KHz, and therefore the update interval logic operates on 16 input samples per update interval m. The detector calculates a local AMDF value over the interval m for each of the pitch periods K. The local AMDF value $AMDF16_m(K)$ for each pitch period K is equal to:

$$AMDF16_m(K) = \sum_{n=1}^{16} |x(n) - x(n-K)|$$

where x(n) is sample n from the buffer and x(n−K) is a prior sample which precedes sample n by K samples. As shown in FIG. 6, the double buffer system (described above) stores a sufficient number of prior samples so that $AMDF16_m(K)$ can be calculated for all values of K.

For each value K, the detector maintains a global AMDF value AMDF(K) which is a running sum of the local AMDF values over the 12 update intervals:

$$AMDF(K)=AMDF(K)+AMDF16_m(K)$$

The detector also determines the minimum local AMDF value $MinAMDF16_m$ over all of the pitch periods K for the interval m:

$$MinAMDF16_m=\min[AMDF16_m(K)]$$

It is interesting to note that the value of K at which $AMDF16_m(K)$ is minimum represents the estimated pitch over the interval m for the prior art AMDF pitch estimation technique, although the particular value of K is irrelevant to the present invention.

Finally, the detector maintains an average difference of the minimum AMDF values AvgDiffAMDF which is a running sum of the differences between the minimum local AMDF value for the interval m and the minimum local AMDF value for the previous interval (m−1):

$$AvgDiffAMDF=AvgDiffAMDF+|MinAMDF16_m-MinAMDF16_{m-1}|$$

When computing AvgDiffAMDF for the first update interval in a detection cycle, the minimum local AMDF value from the last update interval of the previous detection cycle (i−1) is carried over and used as the value for $MinAMDF16_{m-1}$.

Figure 2:
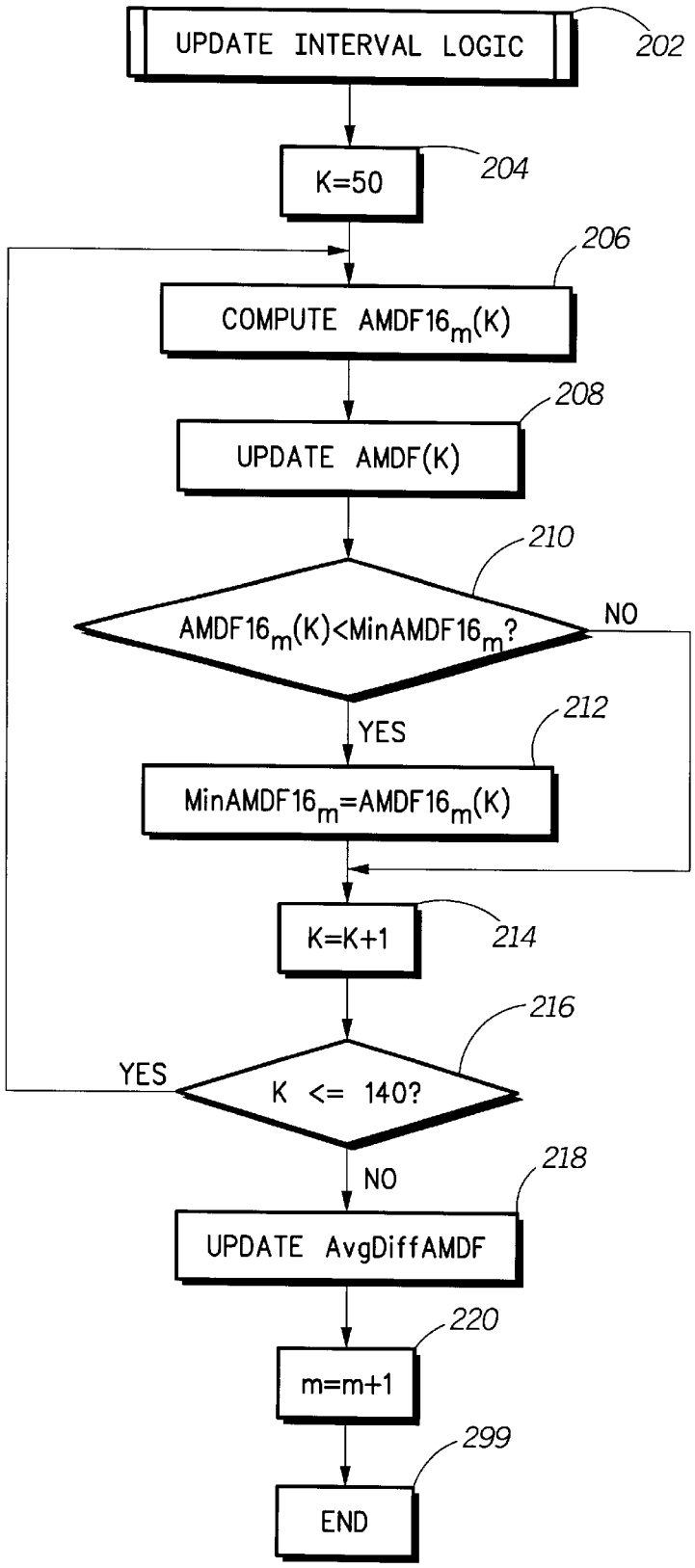
FIG. 2 is a high-level logic flow diagram showing exemplary update interval logic.

A high-level logic flow diagram showing exemplary update interval logic is shown in FIG. 2. When the logic is invoked in step 202, the logic updates the global AMDF value AMDF(K) for each value K and the AvgDiffAMDF which are the running sums carried over from interval to interval. Thus, for each pitch period K beginning with pitch period K equal to 50 in step 204, the logic executes a loop which includes computing the local AMDF value $AMDF16_m(K)$ in step 206, updating the global AMDF value AMDF(K) in step 208, checking whether the local AMDF value $AMDF16_m(K)$ is less than the current minimum local AMDF value $MinAMDF16_m$ in step 210, and saving $AMDF16_m(K)$ as the $MinAMDF16_m$ in step 212 if $AMDF16_m(K)$ is less than $MinAMDF16_m$. The logic then increments K in step 214 and loops back to step 206 to execute the loop for the next value K if K is less than or equal to 140 (YES in step 216). When the execution loop has been completed for all pitch periods K (NO in step 216), the logic proceeds to update the running sum AvgDiffAMDF in step 218. The interval m is then incremented for the next interval in step 220, and the update interval logic terminates in step 299.

When the detector logic is within the decision interval, the detector logic executes the decision interval logic. In the preferred embodiment, no processing is done on the 16 input samples for the decision interval. The decision interval logic uses the metrics computed during the update intervals, among other things, to form a hypothesis as to whether a voice, tone, or noise signal was present during the detection cycle i. After the 12 update intervals, the global AMDF for each value K is effectively equal to:

$$AMDF(K) = {}_{m=1}^{12} AMDF16_m(K)$$

The detector first finds the minimum of the global AMDF values $AMDF_{min}$ over all of the pitch periods K:

$$AMDF_{min}=\min[AMDF(K)]$$

The detector then computes a sum of the global AMDF values $AMDF_{sum}$ over all of the pitch periods K:

$$AMDF_{sum} = \sum_{K=50}^{140} AMDF(K)$$

The detector computes a first metric $AMDF_{norm}$ which effectively compares the minimum of the AMDF over the pitch range to the average AMDF over the pitch range:

$$AMDF_{norm}=AMDF_{min}/AMDF_{sum}$$

The detector computes a second metric $AvgDiffAMDF_{norm}$ which measures the average variation of the minimum AMDF over the update intervals:

$$AvgDiffAMDF_{norm}=AvgDiffAMDF/AMDF_{sum}$$

It is important to note that by using the sum of the global AMDF values $AMDF_{sum}$ as the divisor rather than calculating an average of the global AMDF values, processing resources are conserved. It is also important to note that $AMDF_{norm}$ and $AvgDiffAMDF_{norm}$ are only computed if $AMDF_{sum}$ is non-zero in order to avoid a divide-by-zero error.

After computing the two metrics $AMDF_{norm}$ and $AvgDiffAMDF_{norm}$, the detector performs its hypothesis logic in order to decide whether a voice, tone, or noise signal was present during the detection cycle. The general principle applied by the hypothesis logic (although not the preferred embodiment, which is described in more detail below) is that a large value of $AMDF_{norm}$ is typical of a noise signal while a small value of $AMDF_{norm}$ is typical of a non-noise (i.e., voice or tone) signal, although $AMDF_{norm}$ alone is insufficient to determine whether the non-noise signal is a voice signal or a tone signal. Therefore, if $AMDF_{norm}$ is small, $AvgDiffAMDF_{norm}$ is used to determine whether the non-noise signal is a voice signal or a tone signal. A large value of $AvgDiffAMDF_{norm}$ is typical of a voice signal while a small value of $AvgDiffAMDF_{norm}$ is typical of a tone signal.

Figure 3:
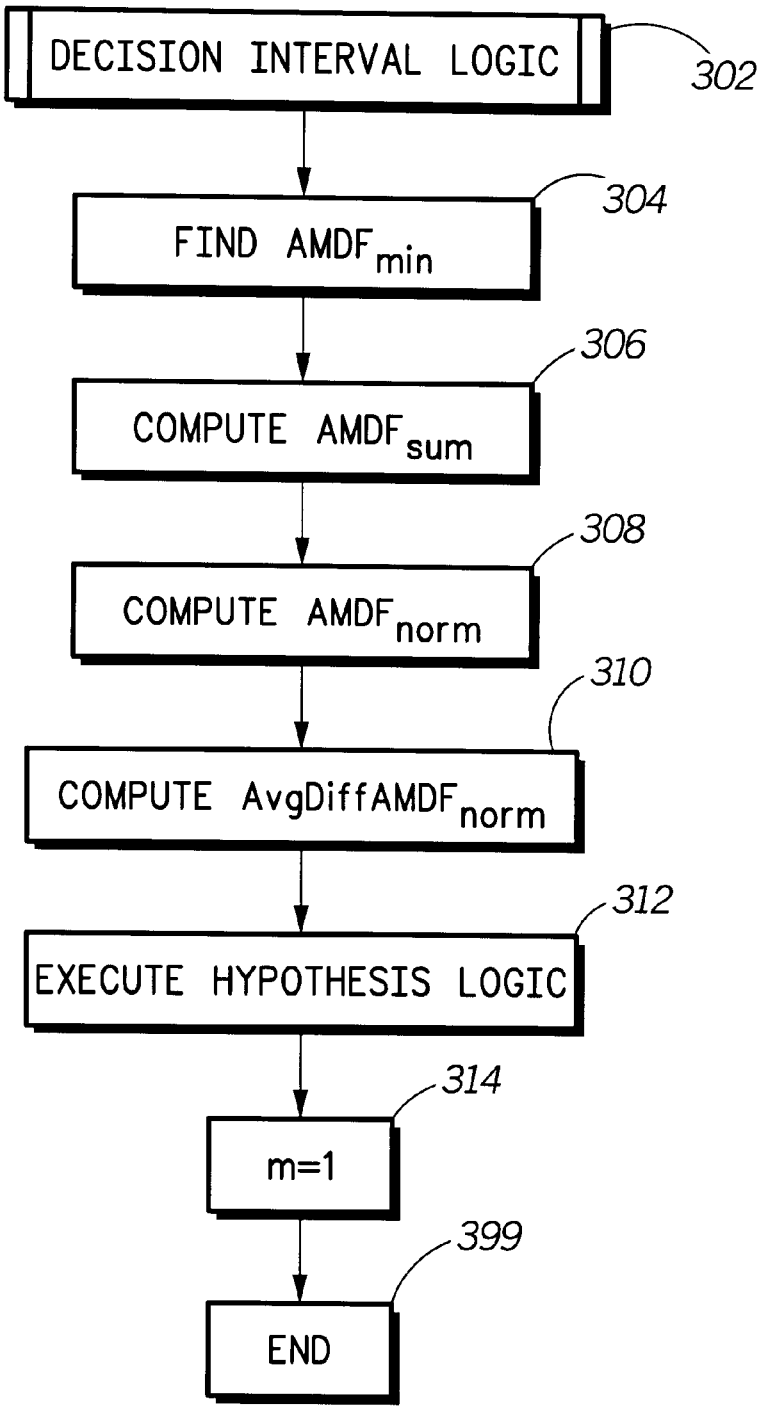
FIG. 3 is a high-level logic flow diagram showing exemplary decision interval logic.

A high-level logic flow diagram showing exemplary decision interval logic is shown in FIG. 3. When the logic is invoked in step 302, the logic proceeds to find $AMDF_{min}$ in step 304, and then computes $AMDF_{sum}$ in step 306. The logic then computes the $AMDF_{norm}$ metric in step 308 and the $AvgDiffAMDF_{norm}$ metric in step 310. Once the two metrics are computed, the logic executes the hypothesis logic in step 312 to determine whether a voice, tone, or noise signal was present during the detection cycle i. The interval m is then set back to one for the next detection cycle in step 314, and the decision interval logic terminates in step 399.

In practice, it has been found that the general hypothesis logic as described above can result in inaccurate decisions under certain circumstances. Specifically, because the two metrics represent averages over time, instantaneous changes from one type of signal to another may not be instantaneously reflected in the metrics. Thus, the hypothesis logic uses the metrics in combination with historic data (i.e., data from previous detection cycles) and appropriate threshold values to make its decision.

The hypothesis logic applies a set of rules which are based on observed characteristics of signals. A first observed characteristic is that once a noise or tone signal is detected, the metrics are likely to settle within particular ranges if the signal remains a noise or tone signal, and therefore the criteria for detecting subsequent noise or tone signals can be made less stringent. A second observed characteristic is that, when transitioning from noise to tone, the $AvgDiffAMDF_{norm}$ spikes to a high value and slowly decays back down toward levels more indicative of a tone. Therefore, to increase the speed of tone detection following a transition from noise, the tone detection threshold is raised after such a spike is detected. A third observed characteristic is that, when transitioning from tone to noise, the two metrics are slow to move to their respective noise levels and are consequently misinterpreted as voice. Therefore, the hypothesis logic is prevented from characterizing the signal as voice for two detection intervals following the end of a tone.

Figure 4:
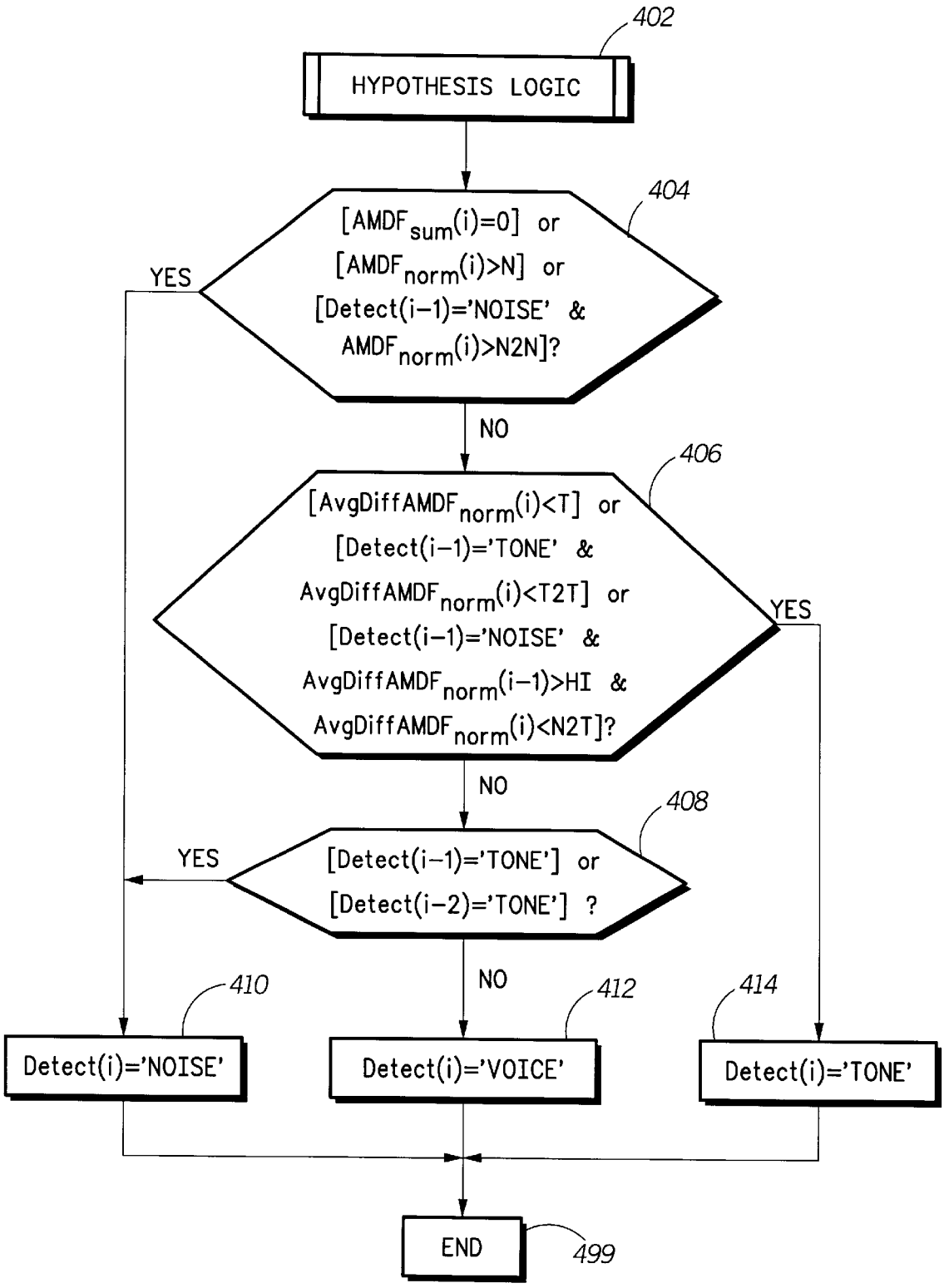
FIG. 4 is a high-level logic flow diagram showing exemplary hypothesis logic.

A high-level logic flow diagram showing exemplary hypothesis logic is shown in FIG. 4. When the logic is invoked in step 402, the logic proceeds to determine if the signal is a noise signal in step 404. In step 404, the signal is characterized as noise, and the logic proceeds to step 410, if any of a number of conditions is true. First, the signal is characterized as noise if the $AMDF_{sum}$ is equal to zero. This case represents the detection of absolute silence. Second, the signal is characterized as noise if the $AMDF_{norm}$ for the current detection cycle i is greater than a threshold N, representing a large value of $AMDF_{norm}$. Finally, the signal is characterized as noise if the signal detected in the previous detection cycle (i−1) was noise and the $AMDF_{norm}$ is greater than a threshold N2N which is less stringent than N. This condition applies the rule from the first observed characteristic described above, specifically that the threshold for detecting subsequent noise signals can be made less stringent.

If the signal is not characterized as noise in step 404, then the logic proceeds to determine if the signal is a tone signal in step 406. In step 406, the signal is characterized as tone, and the logic proceeds to step 414, if any of a number of conditions is true. First, the signal is characterized as tone if the $AvgDiffAMDF_{norm}$ for the current detection cycle i is less than a threshold T. Threshold T is a relatively stringent threshold for initially detecting a tone signal. Second, the signal is characterized as tone if the signal detected in the previous detection cycle (i−1) was tone and the $AvgDiffAMDF_{norm}$ for the current detection cycle i is less than a threshold T2T. This condition applies the rule from the first observed characteristic described above, specifically that the threshold for detecting subsequent tone signals can be made less stringent. Finally, the signal is characterized as tone if the signal detected in the previous detection cycle (i−1) was noise and the $AvgDiffAMDF_{norm}$ for the previous detection cycle (i−1) is greater than a threshold HI (i.e., the spike referred to above) and the $AvgDiffAMDF_{norm}$ for the current detection cycle i is less than a threshold N2T. This condition applies the rule from the second observed characteristic described above.

If the signal is not characterized as tone in step 406, then the logic proceeds to step 408 to apply the rule from the third observed characteristic described above, specifically to prevent the hypothesis logic from characterizing the signal as voice for two detection intervals following the end of a tone. In step 408, the signal is characterized as noise, and the logic proceeds to step 410, if the signal detected in either of the previous two detection cycles (i−1) and (i−2) was tone; otherwise, the signal is characterized as voice, and the logic proceeds to step 412.

As discussed above, the metrics are average values, although the metrics are computed without normalizing over the number of elements over which the average is taken. Instead, the threshold values are scaled appropriately to account for the number of elements over which the metrics were averaged. This scaling technique reduces the computational complexity of computing the metrics by avoiding division operations, thereby reducing the processing resources consumed by the detector.

Thresholds N and N2N apply to $AMDF_{norm}$, which is averaged over the range K only. Therefore, thresholds N and N2N are divided by the number of elements in the average. In the preferred embodiment, threshold N is equal to 0.65/90 and threshold N2N is equal to 0.5/90.

Thresholds T, T2T, N2T, and HI apply to $AvgDiffAMDF_{norm}$, which is averaged over the range K as well as over the 12 intervals. Therefore, thresholds T, T2T, N2T, and HI are multiplied by the number of intervals 12 and divided by the number of elements in the average. In the preferred embodiment, threshold T is equal to 0.0015*12/90, threshold T2T is equal to 0.003*12/90, threshold N2T is equal to 0.009*12/90, and threshold HI is equal to 0.015*12/90.

It is worth noting that the threshold values are described above as though the metrics are averaged over 90 elements. In reality, the metrics are averaged over 91 elements (50 to 140, inclusive). This factoring error does not affect the outcome of the hypothesis logic, since it is the absolute values of the thresholds that determines the outcomes. The absolute threshold values were obtained through experimentation and are based on actual observations of signal characteristics.

While the preferred embodiment distributes the processing demand for each detection cycle over 13 intervals, it will be apparent to a skilled artisan that the input samples for each of the update intervals may be stored and that all calculations may be deferred until the decision interval. It will also be apparent to a skilled artisan that some or all of the intermediate calculations made during each update interval may be deferred until the decision interval.

It will also be apparent to a skilled artisan that the detection cycle can be shortened to 12 intervals, with the decision interval logic for a detection cycle i computed during the first interval of the subsequent detection cycle (i+1).

It will also be apparent to a skilled artisan how the update interval logic and the decision interval logic can be changed for different interval durations, sampling rates, and pitch frequency ranges.

Figure 7:
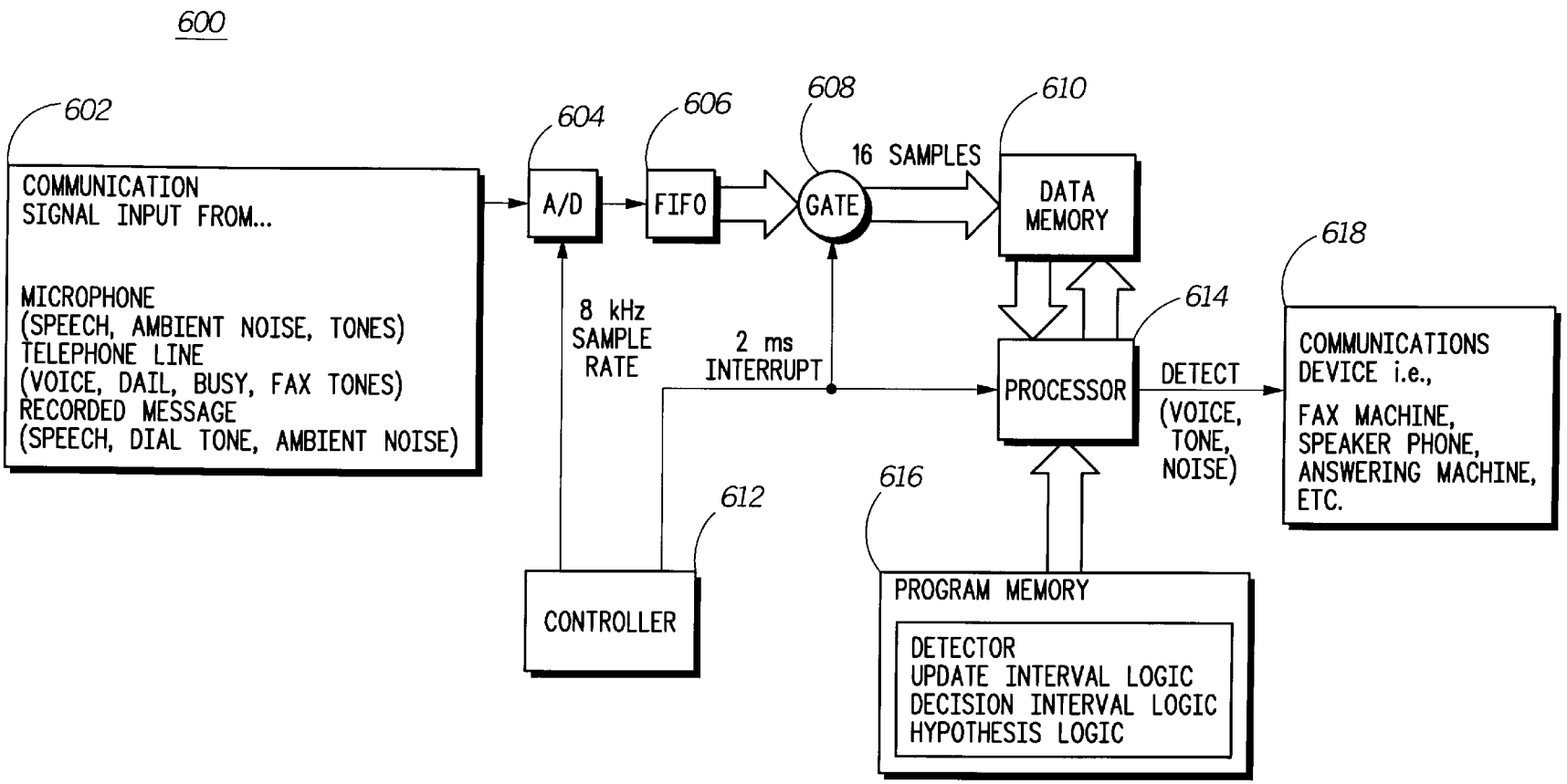
FIG. 7 is a block diagram of a system to execute the methods of the present invention of FIGS. 1–4.

FIG. 7 is a block diagram illustrating a preferred embodiment of the signal detector apparatus 600 used to distinguish a communication signal input 602 between voice, tone or noise signals based on computation of two metrics according to an embodiment of the present invention. The apparatus includes an analog/digital (A/D) converter 604 for converting the analog input signal into a digital signal. Typically, the signal input 602 can be from a microphone (speech, ambient noise or tones) or a telephone line (voice, dial, busy or fax tones) or can be a recorded message (speech, dial tone, ambient noise). The apparatus further includes a FIFO (first in first out) buffer 606 which stores samples from the A/D converter in accordance with the chosen sampling rate. In the preferred embodiment of the invention, the sampling rate is 8 KHz. A gate 608 at the output of the FIFO transfers a block of sixteen input signal samples to a data memory 610 upon an interrupt generated by a controller 612. In the preferred embodiment, the interrupt period is 2 ms that is the update interval. The controller 612 generates the clock and interrupt signals. The interrupt invokes a processor 614 to execute program instructions from a program memory 616 on newly received input samples. In the preferred embodiment, the program memory contains functional blocks of the signal detector comprising the update interval logic block, The decision interval logic block and the hypothesis logic block. At the conclusion of a decision interval, a detect decision is generated and reported to the communications device 618. In the preferred embodiment, the decision interval is 26 ms. Typically, the communications device may be a fax/answering machine, speakerphone, etc.

Figure 8:
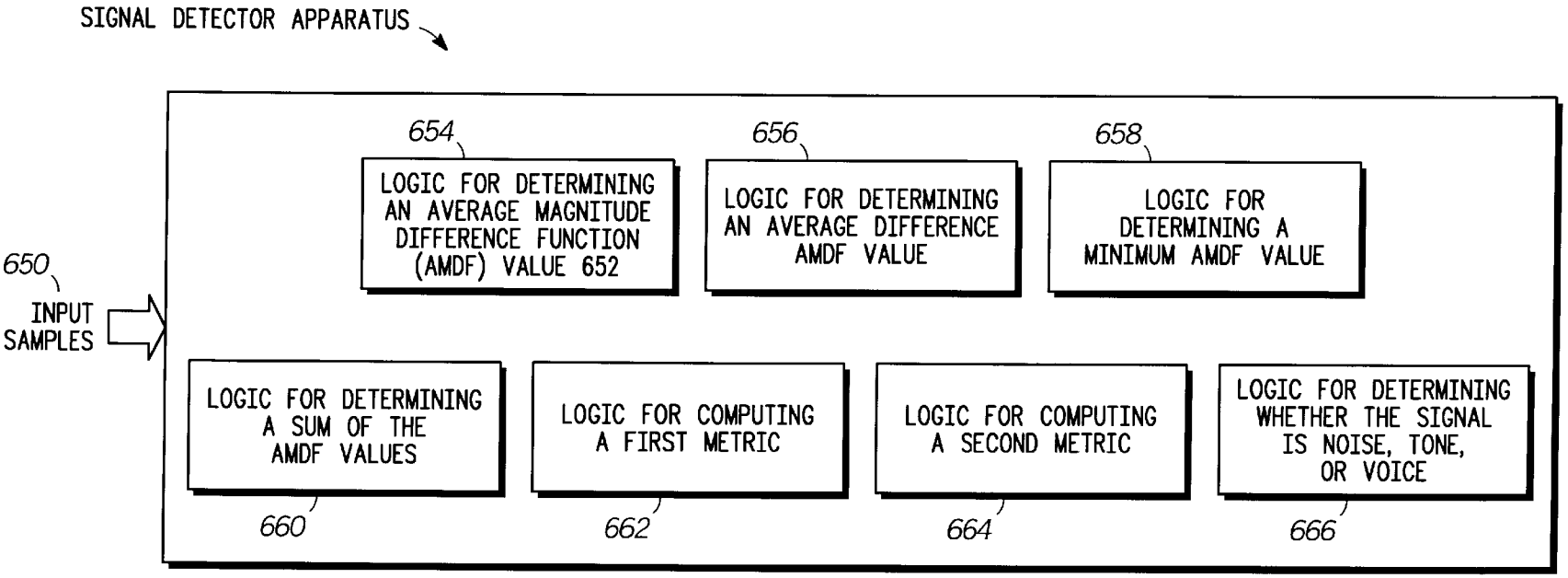
FIG. 8 is a block diagram of the update interval logic and the decision interval logic of FIG. 7.

FIG. 8 is a block diagram of the update interval logic and decision interval logic of FIG. 7. A signal detector apparatus for characterizing a signal over a detection cycle i, the detection cycle i having a number of intervals, each interval having a predetermined number of input samples 650, the device comprising: first logic 654 for determining an Average Magnitude Difference Function (AMDF) value 652 for each of a predetermined range of pitch frequencies K over the intervals; second logic 656 for determining an average difference AMDF value over the intervals equal to the sum of the difference between a first minimum AMDF value from each interval m and a second minimum AMDF value from each interval (m−1); third logic 658 for determining a minimum AMDF value over the intervals; fourth logic 660 for determining a sum of the AMDF values over the intervals; fifth logic 662 or computing a first metric equal to the minimum AMDF value over the intervals divided by the sum of the AMDF values over the intervals; sixth logic 664 for computing a second metric equal to the average difference AMDF value over the intervals divided by the sum of the AMDF values over the intervals; and seventh logic 666 for utilizing said first metric and said second metric to determine whether the signal is one of a noise signal, a tone signal, and a voice signal.

The present invention may be embodied in other specific forms without departing from the essence or essential characteristics. The described embodiments are to be considered in all respects only as illustrative and not restrictive.

What is claimed is:

1. A computer-implemented method for characterizing a signal over a detection cycle having a plurality of time intervals, each time interval having a predetermined number of input samples, the method comprising the steps of:

determining a local Average Magnitude Difference Function (AMDF) value over a predetermined range of pitch frequencies for each of the plurality of time intervals;

determining an average difference AMDF value over the plurality of time intervals from said local AMDF values;

determining a minimum AMDF value over the plurality of time intervals;

determining a sum of the AMDF values over the plurality of time intervals;

computing a first metric equal to the minimum AMDF value over the plurality of time intervals divided by the sum of the AMDF values over the plurality of time intervals;

computing a second metric equal to the average difference AMDF value over the plurality of time intervals divided by the sum of the AMDF values over the plurality of time intervals;

determining from said first metric whether the signal is a noise signal or not a noise signal;

determining from said second metric whether the signal is a voice signal or a tone signal; and providing an output of the determination of signal type.

2. The computer-implemented method of claim 1 wherein said determining from said first metric step further comprises the steps of:

a) characterizing the signal as noise if said first metric is higher than a predetermined noise threshold;

b) characterizing the signal as not noise if said first metric is lower than a predetermined voice/tone threshold; and said determining from said second metric step further comprises the steps of:

c) characterizing the signal as a voice signal if said signal is characterized as not noise and if said second metric is higher than a predetermined voice detection threshold; and d) characterizing the signal as a tone if said signal is characterized as not noise and if said second metric is lower than a predetermined tone detection threshold.

3. The computer-implemented method as in claim 1, wherein said first metric and said second metric are utilized to determine whether the signal is the noise signal, the tone signal, or the voice signal.

4. A device for characterizing a signal over a detection cycle, the detection cycle having a plurality of time intervals, each time interval having a predetermined number of input samples, the device comprising:

first computer logic for determining a local Average Magnitude Difference Function (AMDF) value for each of a predetermined range of pitch frequencies in each of the plurality of time intervals;

second computer logic for determining an average difference AMDF value over the plurality of time intervals from the local AMDF values determined by said first computer logic;

third computer logic for determining a minimum AMDF value over each of said predetermined range of pitch frequencies for the plurality of time intervals;

fourth computer logic for determining a sum of the AMDF values over the plurality of time intervals;

fifth computer logic for computing a first metric equal to the minimum AMDF value over the plurality of time intervals divided by the sum of the AMDF values over the plurality of time intervals;

sixth computer logic for computing a second metric equal to the average difference AMDF value over the plurality of time intervals divided by the sum of the AMDF values over the plurality of time intervals; and seventh computer logic for determining from said first metric whether the signal is noise or not noise and said second metric to determine whether the signal is a tone signal, or a voice signal.

5. The device of claim 4 wherein said seventh computer logic compares said first metric to a predetermined noise threshold, a first metric value higher than the predetermined noise threshold indicating a noise signal, wherein said seventh computer logic compares said first metric to a voice/tone threshold, a first metric value lower than the voice/tone threshold indicating a non-noise signal, wherein said seventh computer logic compares said second metric to a predetermined voice detection threshold, a second metric value larger than the voice detection threshold indicating that the non-noise signal is a voice signal, and wherein said seventh computer logic compares said second metric to a tone detection threshold, a second metric value smaller than the tone detection threshold indicating that the non-noise signal is a tone signal.

6. The device as in claim 4, wherein the value of said first metric indicates whether the signal is noise or not, and the value of the second metric indicates whether the signal indicates a voice or a tone.

7. A computer-implemented method for characterizing a signal over a detection cycle having a plurality of intervals, the method comprising the steps of:

a) determining a local Average Magnitude Difference Function (AMDF) value for a plurality of pitch periods for each of the plurality of intervals;

b) determining an average AMDF value from said local AMDF values;

c) determining a minimum AMDF value over said plurality of pitch periods for each of the plurality of intervals;

d) comparing said minimum AMDF value to said average AMDF value;

d-1) if the difference between said minimum AMDF value and said average AMDF value is higher than a predetermined noise threshold, characterizing the signal type as noise;

d-2) if the difference between said minimum AMDF value and said average AMDF value is lower than a predetermined voice/tone threshold, characterizing the signal as not noise;

e) if the signal is characterized as not noise, determining an average variation value of the minimum AMDF value over the plurality of intervals;

e-1) if said average variation value is larger than a predetermined voice detection threshold, characterizing the signal as a voice signal; and e-2) if said average variation value is smaller than a predetermined tone detection threshold, characterizing the signal as a tone.

8. The computer-implemented method of claim 7 wherein the duration of each of the plurality of intervals is 2 milliseconds.

9. The computer-implemented method of claim 7 wherein the plurality of intervals comprises 13 intervals.

10. The computer-implemented method of claim 9 wherein for 12 of said 13 intervals variations in pitch are detected and for the remaining one interval of said 13 intervals steps d) and e) are performed to characterize the signal.

11. The computer-implemented method of claim 7 further comprising:

f) maintaining a first history of said minimum AMDF value and a second history of said average variation value;

g) determining if historical minimum AMDF values stored in said first history fall into a selected first range and if historical average variation values stored in said second history fall into a second range, said first range indicating a noise and said second range indicating a tone; and h) if said historical minimum AMDF values are found to fall into the first range or said historical average variation values are found to fall into the second range, lowering said predetermined noise threshold and raising said predetermined voice/tone threshold.

12. The computer-implemented method of claim 7 further comprising:

f) maintaining a history of said average variation value;

g) examining said history for a spike-decay pattern indicating a noise to tone transition in the signal, and h) if said spike-decay pattern is detected, raising said predetermined voice/tone threshold.

13. The computer-implemented method as in claim 12, wherein a signal may be more easily determined to not be noise due to selective raising of said predetermined voice/tone threshold.

14. The computer-implemented method of claim 7 further comprising:

f) if steps d) and e) indicate that there is a transition of the signal from a tone to a voice signal, inserting a time delay before characterizing the signal as a voice signal.

15. The computer-implemented method of claim 14, wherein said step of inserting the time delay reduces opportunities for mischaracterizing a noise signal as a voice signal.

16. The computer-implemented method as in claim 7, wherein an input signal is determined to be a voice signal, a tone, or noise by examining variations of pitch over pitch periods and over time intervals.

* * * * *